US006200111B1

(12) United States Patent
Foss

(10) Patent No.: US 6,200,111 B1
(45) Date of Patent: Mar. 13, 2001

(54) CONTROLLABLE HIGH VOLUME POSITIVE DISPLACEMENT PUMP

(76) Inventor: John F. Foss, 4731 Nakoma Dr., Okemos, MI (US) 48864

( * ) Notice: Subject to any disclaimer, the term of this patent is extended or adjusted under 35 U.S.C. 154(b) by 0 days.

(21) Appl. No.: 09/239,120

(22) Filed: Jan. 28, 1999

(51) Int. Cl.[7] ..... F04B 7/00

(52) U.S. Cl. ..... 417/515; 137/50; 137/628; 251/215

(58) Field of Search ..... 417/515, 286, 417/297; 137/627.5, 50, 628; 251/215; 74/25, 30, DIG. 7, 423; 474/69; 123/90.44

(56) References Cited

U.S. PATENT DOCUMENTS 1,060,803 * 5/1913 Welch ..... 74/3
2,889,783 * 6/1959 Woydt ..... 103/169
3,266,435 * 8/1966 Smith ..... 103/170
4,787,822 * 11/1988 Bennett ..... 417/2
5,375,625 * 12/1994 Reynolds ..... 137/625.69
5,690,567 * 11/1997 DeNijs ..... 474/73

* cited by examiner

*Primary Examiner*—Timothy S. Thorpe
*Assistant Examiner*—Ehud Gartenberg
(74) *Attorney, Agent, or Firm*—Brinks Hofer Gilson & Lione

(57) ABSTRACT

A controllable positive displacement pump for liquids and gases which may contain dispersed phase particles includes a pair of pistons operating out of phase. Each of the pistons is associated with an inlet valve which includes a fixed grating defining slots which extend parallel to piston travel and a complementarily configured grating which reciprocates transversely in timed relationship with the piston to control the influx of fluid. A rotary outlet valve is also associated with each piston and includes a rotating member disposed transversely across the cylinder head and which rotates in synchronism to open a through, radial port in the member in timed relationship to the piston travel. The positive displacement pump finds particular application to transport powder paint.

20 Claims, 9 Drawing Sheets

CONTROLLABLE HIGH VOLUME POSITIVE DISPLACEMENT PUMP

BACKGROUND OF THE INVENTION

The invention relates generally to positive displacement pumps for liquids and gases and more specifically to a controllable positive displacement pump having a pair of pistons operating out of phase and specially configured and controllable inlet valves.

Positive displacement pumps for liquids and gases typically include one or more piston and cylinder assemblies and associated inlet and outlet valves which control the flow of pumped fluid into and out of the cylinders. Such pumps are typically capable of relatively high pressure rise operation. A drawback of such positive displacement pumps is that both the inflow and outflow are distinctly pulsatile in character and, especially with high pressure pumps, the flow rates are generally relatively small.

Furthermore, the ability to adjust pressure and flow rates with such pump can be problematic. Typically, of course, flow rates may be adjusted simply by reducing the speed of the pump. However, such a speed reduction to reduce output flow rate is typically accompanied by a reduction in the output pressure as well.

It is apparent from the foregoing that a positive displacement pump which addresses the problems of output pulsation and controllable flow characteristics would represent an improvement over currently available devices.

SUMMARY OF THE INVENTION

The present invention is directed to a controllable, high volume positive displacement pump which provides a flow rate having temporal fluctuations which are a smaller fraction of the time mean value than those of conventional positive displacement pumps, is characterized as a higher flow rate, smaller pressure rise device in comparison to conventional positive displacement pumps and readily permits independent control of the intake and exhaust valve phasing and cycle times.

A controllable positive displacement pump for liquids and gases which may contain dispersed phase particles includes a pair of pistons operating out of phase which provide pumped fluid to a common output. Each of the pistons is associated with an inlet valve which includes a fixed grating defining slots which extend parallel to piston travel and a complementarily configured grating which reciprocates transversely in timed relationship with the piston to control the influx of fluid. A rotary outlet valve is also associated with each piston and includes a rotating member disposed transversely across the cylinder head which rotates in synchronism to open a through, radial port in the member in timed relationship to the piston travel. The phase relationship between the operation of the inlet and outlet valves and the respective pistons may be adjusted by using either independent drive mechanisms to these components or incorporating mechanical phase adjusting devices in the unitary drive mechanism. The positive displacement pump finds particular application to transport powder paint and in heating, ventilating and air conditioning (HVAC) apparatus.

Thus it is an object of the present invention to provide a controllable, positive displacement pump.

It is a further object of the present invention to provide a controllable, positive displacement pump suitable for applications such as transport of powder paint and in HVAC apparatus.

It is a still further object of the present invention to provide a controllable, positive displacement pump wherein inlet and outlet valves operate in synchronism with reciprocating pistons.

It is a still further object of the present invention to provide a controllable, positive displacement pump wherein the phase relationships of the inlet and outlet valves may be adjusted relative to the reciprocating pistons.

Further objects and advantages of the present invention will become apparent by reference to the following description of the preferred and alternate embodiments and appended drawings wherein like reference numbers refer to the same component, element or feature.

DESCRIPTION OF THE PREFERRED AND ALTERNATE EMBODIMENTS

Figure 1:
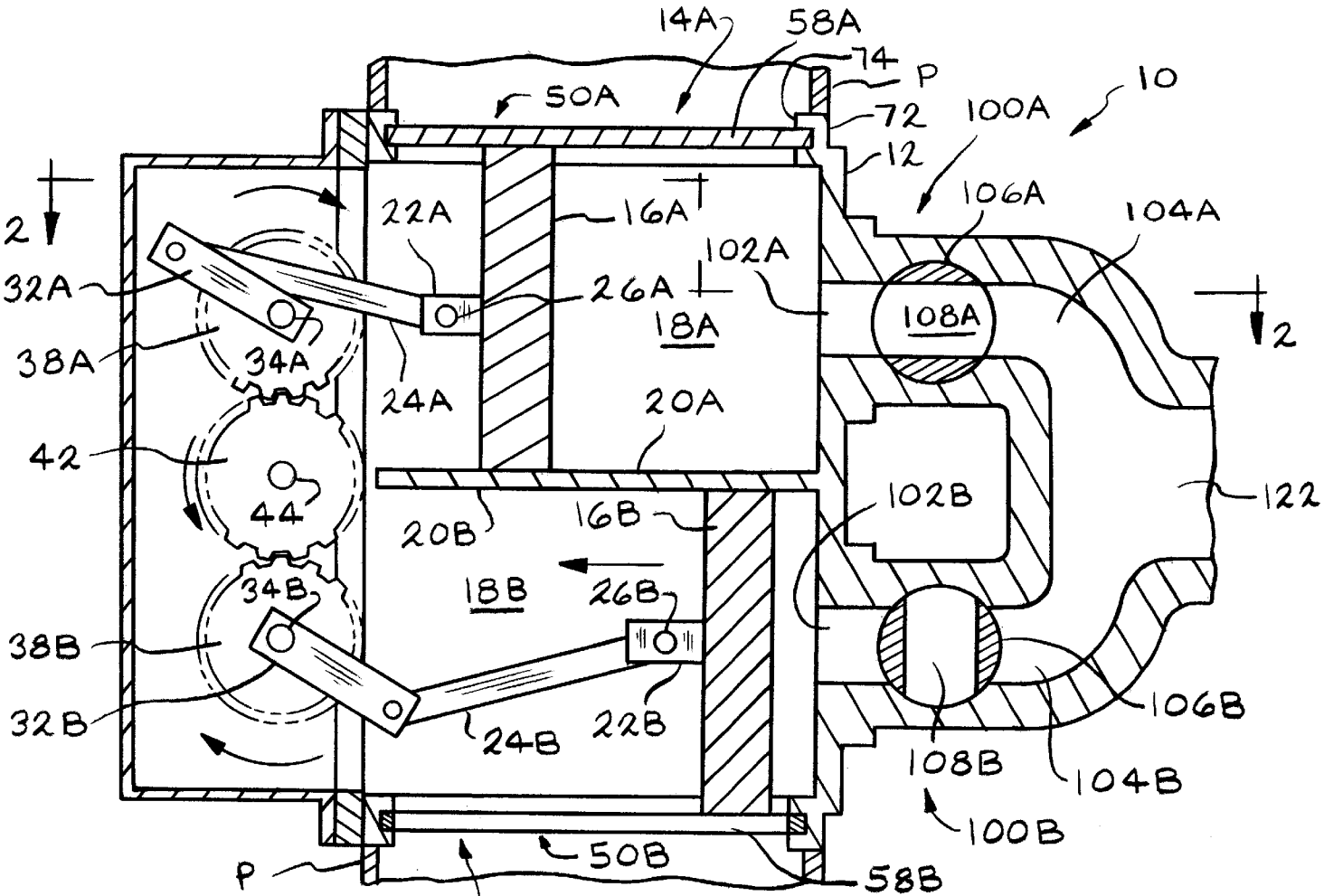
FIG. 1 is a side, elevational view in full section of a controllable positive displacement pump according to the present invention.
Figure 2:
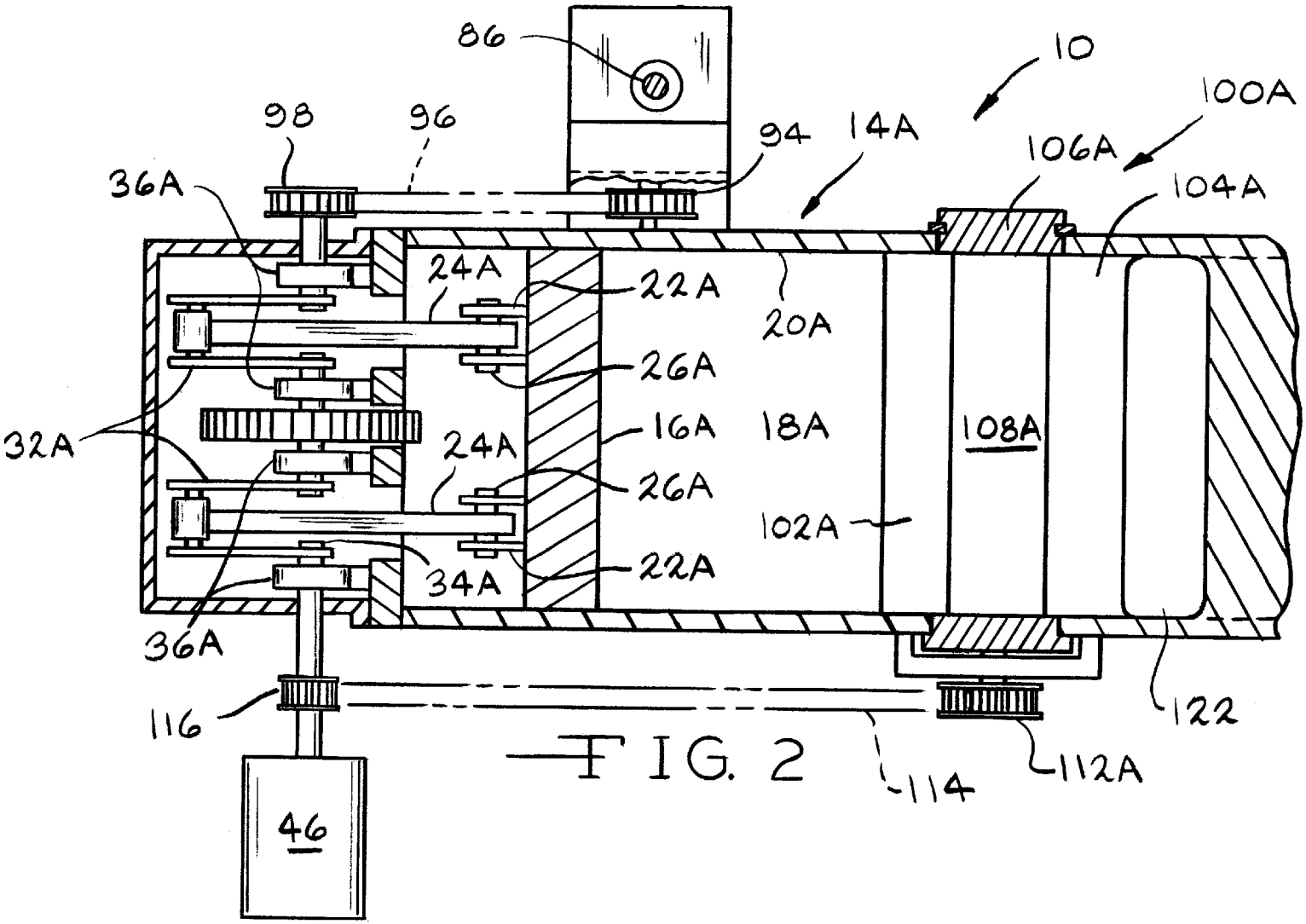
FIG. 2 is a full, sectional view of one of the piston and cylinder assemblies of a controllable positive displacement pump according to the present invention take along line 2—2 of FIG. 1.

Referring now FIGS. 1 and 2, a controllable, high volume, positive displacement pump according to the present invention is illustrated and generally designated by the reference number 10. The positive displacement pump 10 includes a housing 12 which is preferably cast metal and includes various apertures, surfaces and ports which cooperate with other features of the invention. Specifically, the positive displacement pump 10 includes an upper or first piston and cylinder assembly 14A and a lower or second piston and cylinder assembly 14B. The upper piston and cylinder assembly 14A and the lower piston and cylinder assembly 14B are substantially identical and the upper piston and cylinder assembly 14A includes a first preferably rectangular piston 16A disposed within a complementary first rectangular cylinder 18A defined by a first rectangular cylinder wall 20A. The piston 16A includes a first pair of devises 22A which receive a respective first pair of connecting rods 24A which are pinned to the devises by a respective first pair of retaining pins 26A. The first pair of connecting rods 24A are in turn pivotally received on a first pair of respective cranks 32A of an first crankshaft 34A. The first crankshaft 34A is supported for a rotation in a plurality of first bearings 36A which may define either standard journal bearings or anti-friction devices such as ball bearing assemblies (not illustrated). Secured generally centrally to the crankshaft 34A is a first driven pinion gear 38A which is in constant mesh with a drive pinion gear 42. The drive pinion gear 42 is secured to a transverse drive shaft 44 and driven by a prime mover such as a variable speed electric motor 46.

The lower or second piston and cylinder assembly 14B is in all mechanical respects the same as the upper piston and cylinder assembly 14A except that it operates 180° out of phase with the first or upper piston and cylinder assembly 14A. Thus, it includes a second piston 16B, a second cylinder 18B, a second cylinder wall 20B, second pairs of devises 22B, a second pair of connecting rods 24B, a second pair of retaining pins 26B, a second pair of cranks 32B, a second crankshaft 34B, second bearings and a second driven pinion gear 38B. It will be appreciated that the first cranks 32A and the second cranks 32B are arranged 180° out of phase from one another as illustrated in FIG. 1.

Turning now to FIGS. 1, 3, 4 and 5, each of the first and second piston and cylinder assemblies 14A and 14B includes a respective inlet valve assembly 50A and 50B. The upper or first inlet valve assembly 50A is disposed adjacent the upper cylinder wall 20A of the first or upper piston and cylinder assembly 14A and the second or lower inlet valve assembly 50B is disposed adjacent the lower cylinder wall 20B of the second or lower piston and cylinder assembly 14B. The inlet valve assemblies 50A and 50B, but for their locations, are mechanically identical with the exception that once again, they operate 180° out of phase from one another. Hence, only the first or upper inlet valve assembly 50A will be described, it being understood that the same description applies to the second or lower inlet valve assembly 50B.

Formed in the upper portion of the cylinder wall 20A are a plurality of longitudinally extending slots 52 defined by longitudinally extending bars 54. Received within the slots 52 defined by the bars 54 are complementarily configured rectangular teeth or projections 56 which form and define the upper edge of the piston 16A. Transversely, slidingly disposed immediately above and adjacent the grating defined by the bars 54 is a complementarily configured valve plate 58 having a plurality of longitudinally extending slots 62 having generally trapezoidal cross sections which are defined by a complementarily configured arrangement of trapezoidally shaped bars 64. The adjacent, facing surfaces of the bars 54 and 64 as well as the edges of the teeth 56 of the piston 16A are preferably uniformly polished or finished such that they slide smoothly against one another in intimate contact to provide a suitable fluid tight seal. The valve plate 58 is slidingly retained upon the top of the piston and cylinder assembly 14A by a pair of parallel, right angle (L-shaped) guides 72 having overhanging lips 74.

The inlet valve assembly 50A and specifically the valve plate 58 is reciprocated in proper timed relationship with the motion of the first piston 16A by a cam 76 and a follower 78 and is open when the first piston 16A is on its intake stroke and is closed when the first piston 16A is on its compression stroke.

Figure 3:
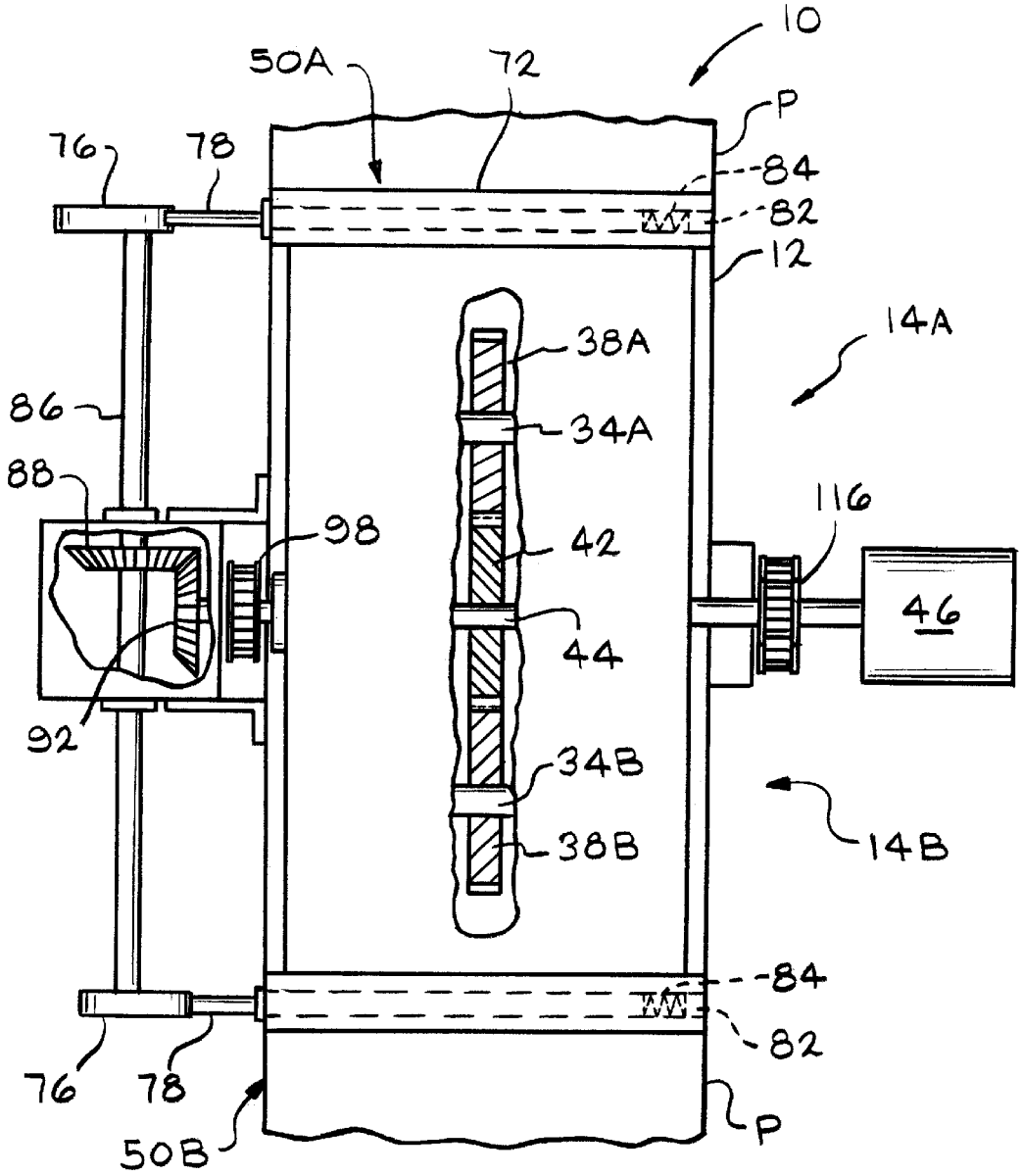
FIG. 3 is an end, elevational view with portions broken away of a controllable positive displacement pump according to the present invention.

Each of the guides 72 includes a closed end portion 82 which receives a compression spring 84 which biases the valve plate 58A and provides restoring force to return it to the left is illustrated in FIG. 3 to achieve proper reciprocation of the plate 58 as will readily be appreciated. The cam 76 is coupled to a drive shaft 86 to which a bevel gear 88 is secured. The bevel gear 88, in turn, is driven by a matching bevel gear 92. As shown in FIGS. 2 and 3, the bevel gear 92 is coupled to a driven pinion 94 and, through a timing belt or chain 96, to a drive pinion 98 secured to the drive shaft 44. The drive ratio from the drive shaft 44, through the timing belt 96 and through the bevel gears 88 and 92 is 1:1 and thus the cams 76 and the valve plates 58A and 58B operate in synchronism with the motion of the pistons 16A and 16B.

Returning now to FIGS. 1 and 2, each of the piston and cylinder assemblies 14A and 14B also includes respective rotary outlet valve assemblies 100A and 100B. The upper or first rotary valve assembly 100A and lower or second rotary valve assembly 100B are mechanically identical and again, the only difference being operational in that they typically operate 180° out of phase from one another, in synchronism with the motion of the associated respective pistons 16A and 16B. Accordingly, only the first or upper outlet valve assembly 100A will be described. In the headwall of the cylinder wall 20A is a slot 102A defined by the housing 12 which preferably extends substantially the full width of the piston 16A and the cylinder 18A. The slot 102A opens into a passageway 104A communicating with a rotary valve body 106A. Disposed across the full width of the slot 102A and between the slot 102A and the passageway 104A is a rotary valve body 106A having a through radial passageway 108A defining a height substantially equal to the height of the slot 102A and the passageway 104A. The remaining material in the valve body 106A adjacent the passageway 108A when rotated 90° is sufficiently wide to fully close off the passageway 104A from the cylinder 18A and the slot 102A. The rotary valve body 106A is coupled to a drive pinion 112A which is driven through a timing belt 114 from a pinion 116 secured to the crankshaft 34B. It will be noted that the driven pinion 112A has a diameter twice as large as the drive pinion 116 and this configuration effects a 2:1 speed reduction such that the rotary valve body 106A rotates one revolution for every two revolutions of the crankshaft 34A. Flow through a slot 102B and through a passageway 108B in the rotary valve body 106B is similarly controlled. As illustrated in FIG. 1, the passageway 104A merges with a similar passageway 104B from the second or lower piston and cylinder assembly 14B and thus fluid flow from the cylinders 18A and 18B merge in a common outlet passageway 122.

Figure 6:
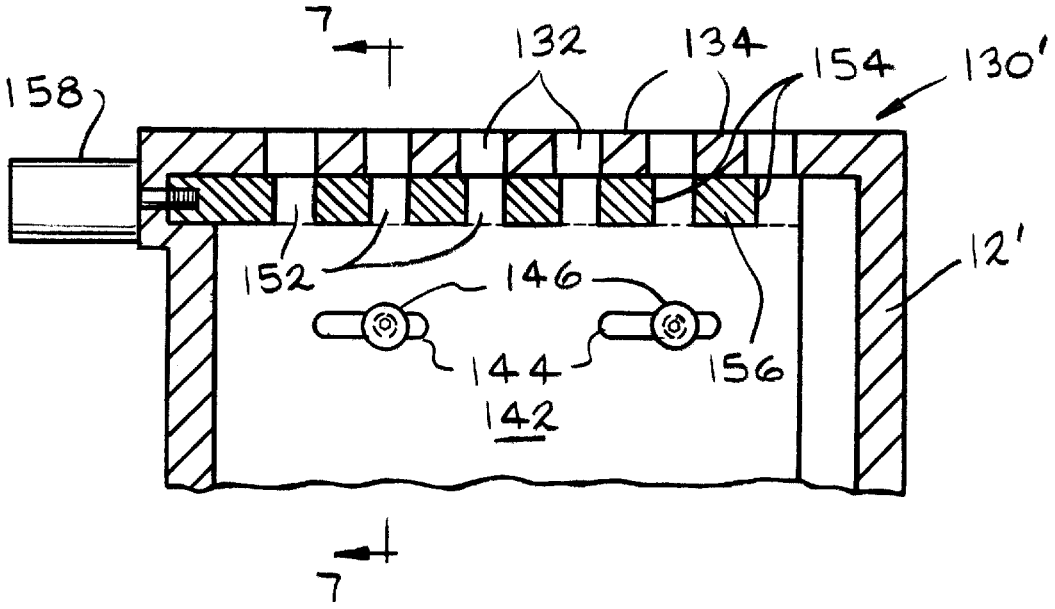
FIG. 6 is a fragmentary, sectional view of a first alternate embodiment piston and inlet valve configuration according to the present invention.
Figure 7:
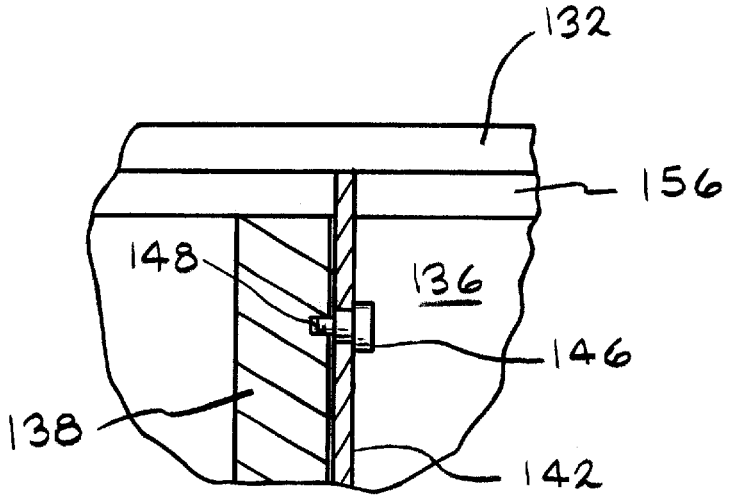
FIG. 7 is a fragmentary, sectional view of the first alternate embodiment piston and inlet valve configuration according to the present invention taken along 7—7 of FIG. 6.

Turning now to FIGS. 6 and 7, a first alternate embodiment inlet valve assembly 130 which relates to the interface and seal between the pistons 16A and 16B and their respective inlet valve assemblies 50A and 50B is illustrated. The first alternate embodiment inlet valve assembly 130 includes an alternate embodiment housing 12' having a plurality of longitudinal slots 132 defined by a plurality of parallel, longitudinal bars 134. The bars 134 are preferably integrally formed with the housing 12' when it is fabricated, for example, by casting. The slots 132 provide fluid communication between the ambient and a cylinder 136 defined by the housing 12'. Disposed within the cylinder 136 is a reciprocating piston 138. It will be appreciated that but for the differences about to be described, the piston 138 is the same as the first and second pistons 16A and 16B, respectively, described above with regard to the preferred embodiment positive displacement pump 10. The piston 138 includes a transversely slidable plate 142 having at least a pair of elongate slots 144 through which a respective pair of shoulder bolts 146 are disposed. The shoulder bolts 146 mount into suitably configured blind apertures 148 in the piston 138 and retain and slidably position the plate 142 upon the face of the piston 138. The plate 142 includes a plurality of rectangular teeth or projections 152 which are received within complementarily configured elongate slots 154 in a valve plate 156.

The valve plate 156 is transversely reciprocated through the agency of a cam and follower assembly 158 which is similar in all respects to the cam 76 and follower 78 of the preferred embodiment pump 10. As the piston 138 reciprocates within the cylinder 136, the alternate embodiment inlet valve assembly 130 alternately allows ingress of pumped fluid and compression thereof by opening and closing in synchronism with the piston 138 by first placing the slots 132 and 154 in alignment as illustrated in FIG. 6 and then closing off the slots 132 with the bars of the valve plate 156 as it reciprocates. The plate 142 thus provides an appropriate seal while accommodating the interfacial motion of the reciprocating piston 138 along its axis and the transversely oriented reciprocating motion of the valve plate 156.

Figure 8:
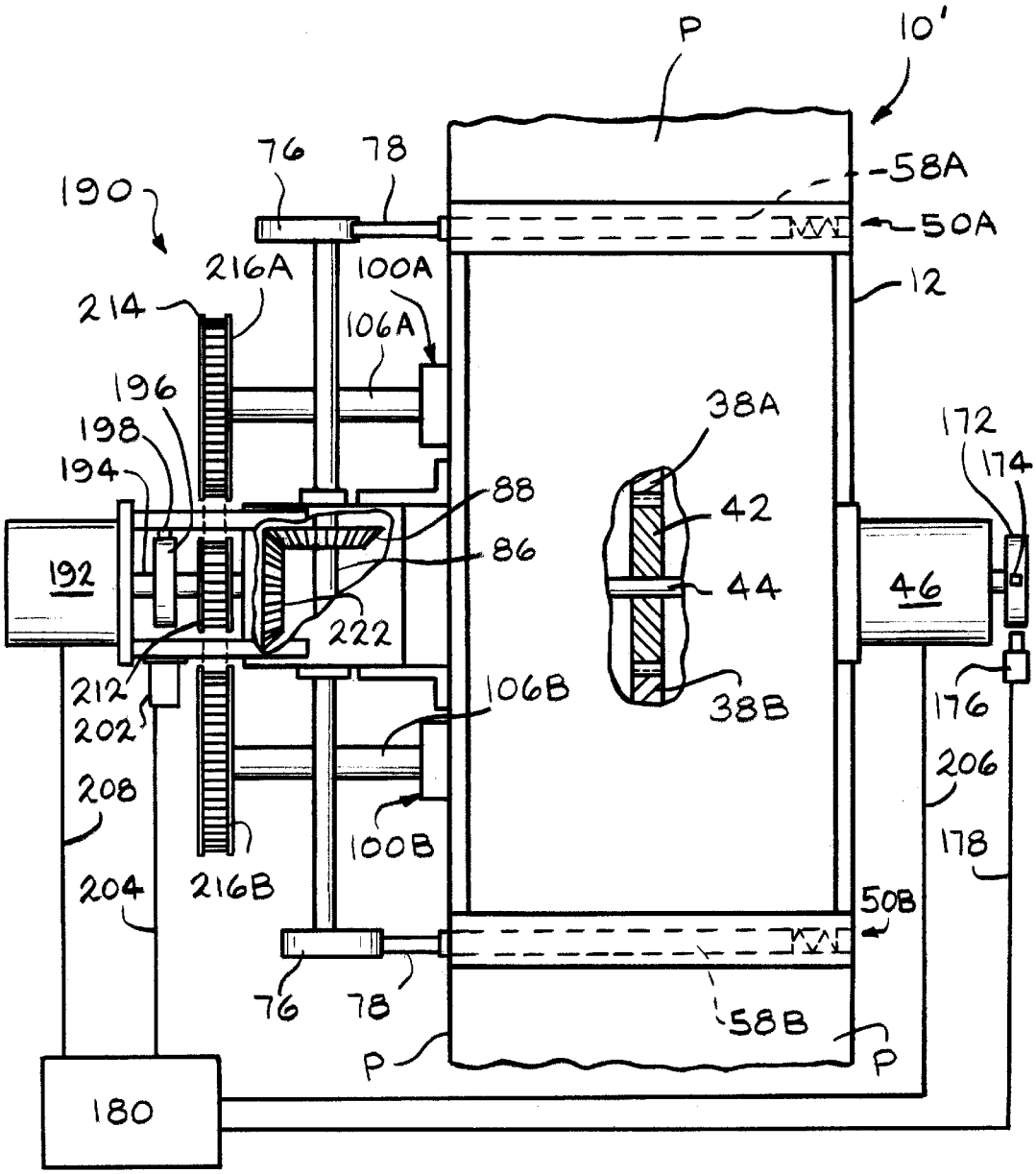
FIG. 8 is an end, elevational view with portions broken away of a second alternate embodiment controllable positive displacement pump according to the present invention having independent phase adjustable drives for the pistons and valves.

Referring now to FIG. 8, a second alternate embodiment of a controllable positive displacement pump 10' is illustrated. The positive displacement pump 10' is identical to the preferred embodiment positive displacement pump 10 in all respects with regard to the mechanical configuration of the piston and cylinder assemblies 14A and 14B, the inlet valve assemblies 50A and 50B and the rotary outlet valve assemblies 100A and 100B. The second alternate embodiment pump assembly 10' differs from the preferred embodiment pump 10 in the drive mechanisms for the components and more particularly to the capability of the drive mechanisms to adjust the phasing therebetween. Accordingly, the second alternate embodiment pump 10' includes the drive motor 46 which directly drives the shaft 44, the drive pinion gear 42 and the driven pinion gears 38A and 38B. Attached to the drive shaft 42 is a tone wheel 172 having one or more teeth 174 which are configured to permit angular or phase resolution of the position of the shaft 42 and thus of the pistons 16A and 16B. A sensor such as a Hall effect or variable reluctance sensor 176 is disposed in sensing relationship with the tone wheel 172 and provides a signal through a line 178 to a controller 180.

Driving and operating completely independently of the drive motor 46 is a valve drive assembly 190. The valve drive assembly 190 includes a variable speed electric drive motor 192 providing energy to a drive shaft 194 and a tone wheel 196 having a single or multiple set of teeth 198 from which the position or phase of the shaft 194 may be deduced. A sensor 202 such as a Hall effect variable reluctance sensor provides a signal through a line 204 to the controller 180. Given the signals from the two phase sensor wheels 176 and 202, the controller 180, when provided with operating programs and criteria, is capable of providing independent electrical power through the conductors 206 to the motor 46 and through the conductors 208 to the motor 192 thereby adjusting the speed and phase of the variable speed electric drive motors 46 and 192 to adjust the relative phase relationship between the pistons 16A and 16B and the inlet valve assemblies 50A and 50B and the outlet valve assemblies 100A and 100B.

Affixed to the shaft 198 is a belt drive pinion 212 which drives a timing belt or chain 214 which engages drive pinions 216A and 216B which are coupled to the rotary valve bodies 106A and 106B and rotate them together.

The drive shaft 194 terminates in a first bevel gear 222 which mates with the second bevel gear 88 secured to the shaft 86. The shaft 86 is terminated by the pair of cams 76 which cooperate with the cam followers 78 to reciprocably drive the valve plates 58A and 58B of the respective inlet valve assemblies 50A and 50B. It will thus be appreciated that the independent electric drives to, first of all, the piston and cylinder assemblies 14A and 14B and, second of all, the inlet valve assemblies 50A and 50B and the outlet valve assemblies 100A and 100B allow phase independent operation of these components to improve and adjust the operating characteristics of the positive displacement pump 10'.

Such independent control may be further expanded such that the pistons 16A and 16B, the inlet valve assemblies 50A and 50B and the outlet valve assemblies 100A and 100B are all independently driven and thus their speed, and more importantly their phase, relative to the other components may be independently adjusted. This additional capability requires the addition of a third electric drive motor and appropriate sensor and modification to the controller 180 of the second alternate embodiment positive displacement pump 10' described directly above to accept a third sensor and provide a third output to the third drive motor. So configured, the drive motor 46 drives the pistons 16A and 16B, the drive motor 192 drives the inlet valve assemblies 50A and 50B and the third drive motor drives the rotary outlet valve assemblies 100A and 100B. As noted, the additional tone wheel and sensor is utilized to provide speed and phase information to the controller as will be readily appreciated. So configured, independent speed and phase control of the pistons 16A and 16B, the inlet valve assemblies 50A and 50B and the rotary outlet valve assemblies 100A and 100B may be achieved.

As shown in FIG. 1, a positive displacement pump 10 according to the present invention will include an pper piston and cylinder assembly 14A and a lower piston and cylinder assembly 14B whose pistons 16A and 16B operate 180° out of phase. The two passageways 104A and 104B deliver fluid to a common outlet 122. This means that the outflow may be characterized as a d.c. level with a superimposed fluctuation that can be described as (for the first cycle)

$$q_{net}\Big]_o^T = q_u\Big]_o^{T/2} + q_e\Big]_{T/2}^T \tag{1}$$

where T is the reciprocal of the driving frequency ($f_d$) and $$\omega = f_d/2\pi. \tag{2}$$

Turning then to the operation of the pump and FIGS. 9, 10, 11 and 12, as suggested by equation (1), the upper passageway 104A will deliver the fluid to be pumped for the time period $nT \leqq t \leqq (2n+1)T/2$ and the lower passageway 104B will deliver fluid during the period $(2n+1)T/2 \leqq t \leqq (n+1)T$. This delivery is powered by the forward advance of the respective pistons 16A and 16B and it is controlled by the angular position ($\phi$) of the rotary outlet valves 106A and 106B illustrated in FIG. 1.

Figure 9:
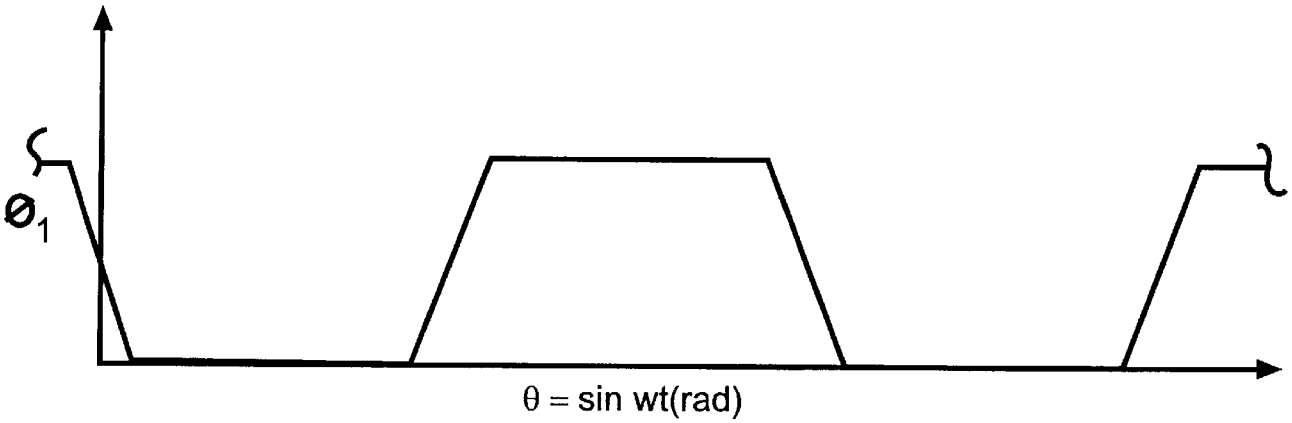
FIG. 9 is a timing diagram for the upper piston and cylinder assembly of a controllable positive displacement pump according to the present invention at maximum flow rate.

FIG. 9 shows the timing diagram for the rotary outlet valve 106A for the upper piston and cylinder assembly 14A and for the conditions of maximum flow rate. The timing diagram for the lower piston and cylinder assembly 14B is identical to that of FIG. 9 except it is shifted by 180°. This diagram is presented for the rotary position of $\phi_1$ of the upper rotary outlet valve 106A as a function of the crank angle $\theta_1(t)$ of the crankshaft 34A. It is assumed, for the present discussion, that $\theta_1(t)$ is the linear function:

$$\theta_1(t)=\omega t \tag{3}$$

and that $\omega$=constant. This restriction is modified in a subsequent section in order to gain enhanced performance of the pump 10 in HVAC heat exchanger applications.

Figure 11:
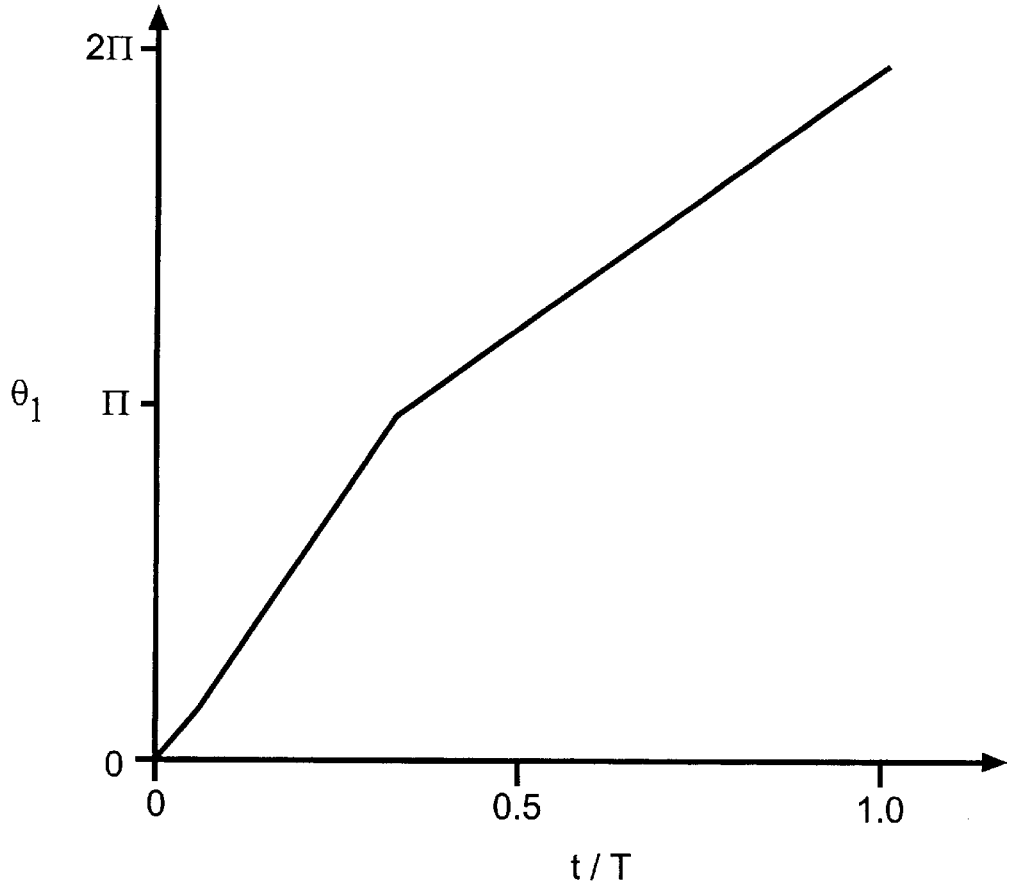
FIG. 11 is a graph presenting the crank angle position versus time over one operating cycle of a controllable positive displacement pump according to the present invention.

FIG. 11 presents the crank angle position versus time of one rotation of the crankshaft showing a non-linear relationship therebetween.

The second element of the controlled flow rate condition of the pump 10 is that of the sliding plates 58A and 58B with respect to the fixed bars 54.

Figure 4:
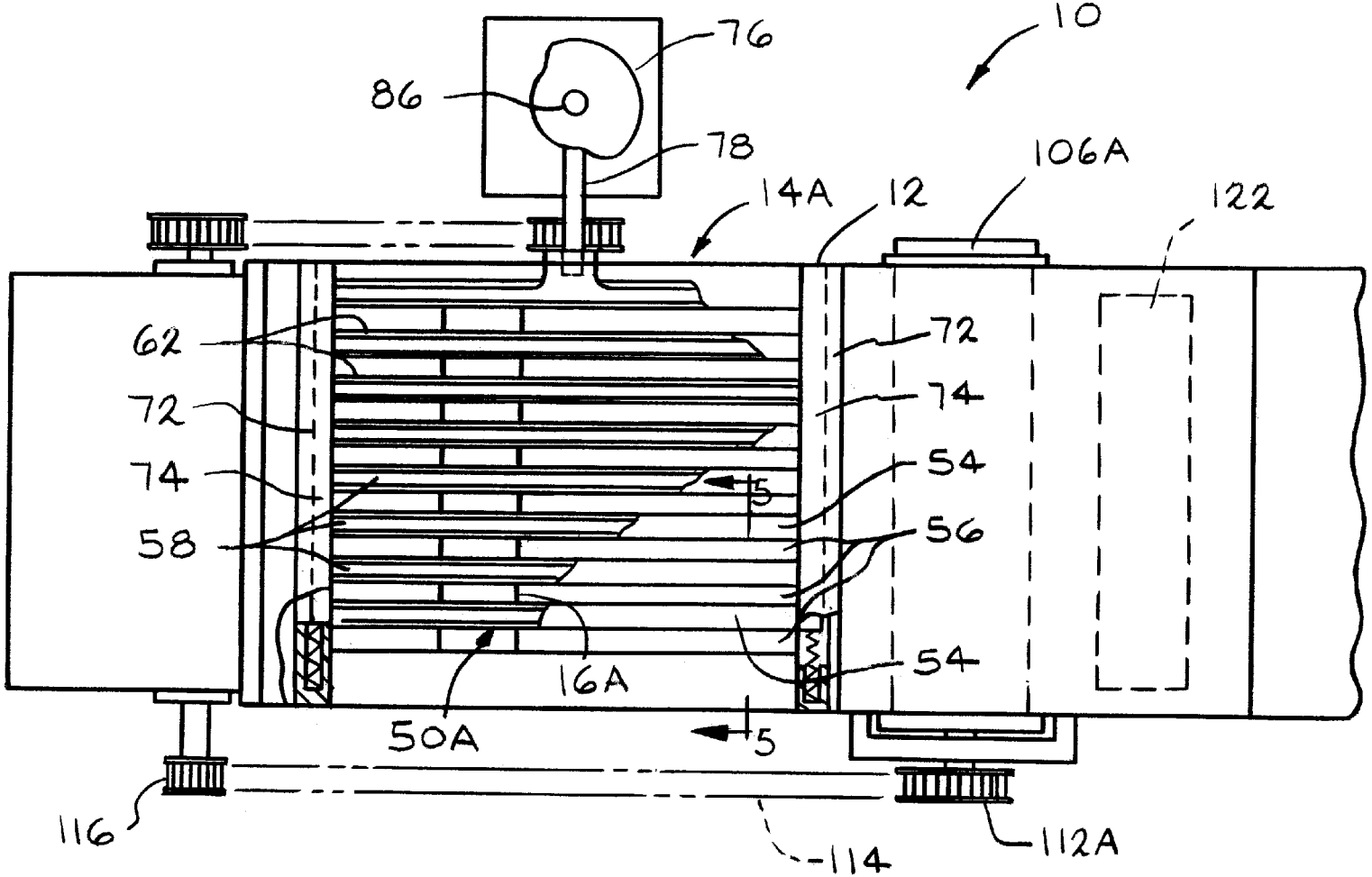
FIG. 4 is a top, plan view of a controllable positive displacement pump according to the present invention.
Figure 5:
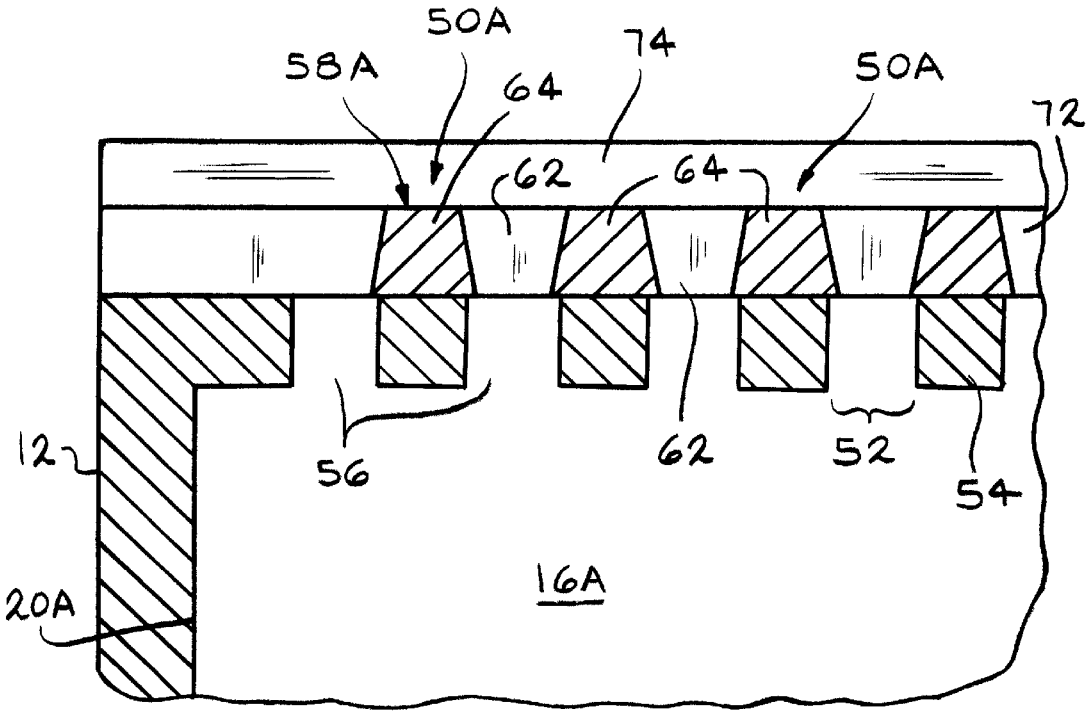
FIG. 5 is a fragmentary, sectional view of an inlet valve of a controllable positive displacement pump according to the present invention taken along line 5—5 of FIG. 4.

FIGS. 4 and 5 show the top and end views of the sliding inlet valve assemblies 50A and 50B. The symbol $\xi_B$ refers to the lateral position of the sliding plate 58A. The upper passageways are closed for $\xi_B=0$; they are fully open for $\xi_B=-W_A$.

Figure 10:
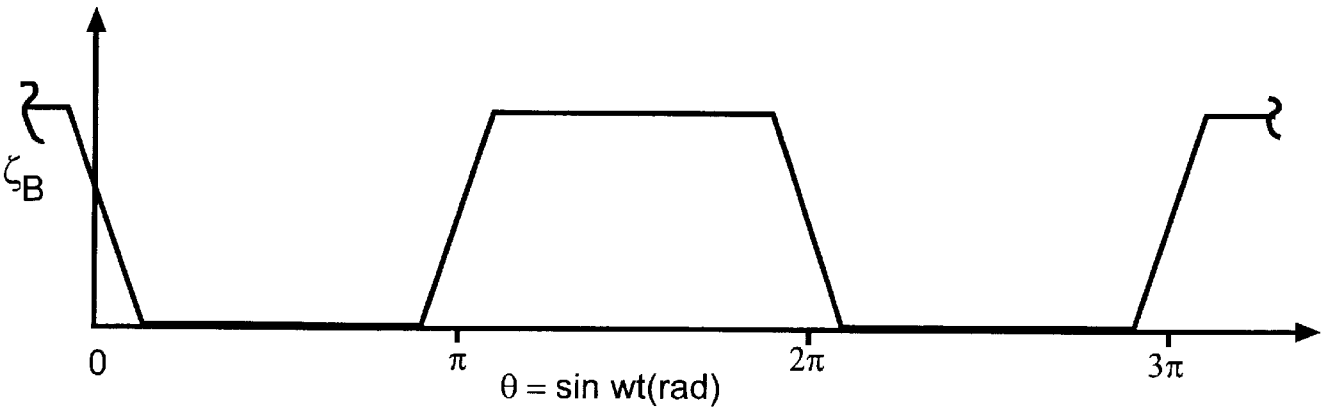
FIG. 10 is a graph presenting the position of the upper inlet valve sliding plate of a controllable positive displacement pump according to the present invention as a function of the crank angle for a maximum flow rate condition.

FIG. 10 shows the inlet valve plates 58A and 58B plate positions: $[\xi_B(t)]$, for the maximum flow rate condition. Once again, the independent variable is considered to be $\theta_1(t)$ for the present discussion.

The magnitude of the volume flow rate will be linearly proportional to $\omega$ given the condition that the channel is fully filled from the surrounding plenum P on each stroke. (The filling stroke for the upper piston 16A is $\pi \leqq \theta \leqq 2\pi$ as shown in FIGS. 9 and 10.) Given the inertia of the elements involved, the change in flow rate that results from a change in the rotational speed ($\omega$) of the crankshaft 34A is considered to represent a "slow" change of the operating condition.

If the sliding inlet valve plates 58A and 58B ($\xi_B$, $\epsilon_C$) and the outlet valves 106A and 106B ($\phi_1$, $\phi_2$) are used to control the flow, then the delivered mass can be adjusted on a time scale of one-half cycle. That is, for $\omega$=constant, $\phi_1$ can be held at $\phi_1=\pi/2$ (i.e., the rotary outlet valve 106A is closed) and $\epsilon_B=-W_A$ (i.e., the inlet valve plate 58A is open) for a period that is longer than that shown in FIGS. 9 and 10. For example, $$\phi_1=\pi/2 \text{ for } 0\leqq\theta<30 \text{ degrees,}$$

and $$\phi_1\rightarrow 0 \text{ at } \theta=30 \text{ degrees}$$

and $$\phi_1=\pi/2 \text{ at } \theta=150 \text{ degrees}$$

while $$\epsilon_B=-W_A \text{ for } 0\leqq\theta<30 \text{ degrees,}$$

and $$-\epsilon_B\rightarrow 0 \text{ at } \theta=30 \text{ degrees}$$

and $$\epsilon_B\rightarrow -W_A \text{ at } \theta=150 \text{ degrees}$$

Hence, the time period for which material is delivered from the upper passageway 104A is reduced (in terms of the crank angle) from nominally 0→180 degrees to nominally 30→150 degrees. The ingestion portion of the cycle: 180→360 degrees, is unchanged from that of the maximum flow rate condition. However, in the $\theta\rightarrow 30$ degrees and the $\theta$: 150→180 degree segments, the ingested fluid and/or material will be expelled from the channel and returned to the supply plenum P.

If a multiphase, i.e., fluid and particulate, mixture is to be pumped, and if it would be useful to stir the material in the plenum P in order to enhance the uniformity of the discharge mixture, then the fractional operation noted above will provide an added benefit to that of the pumping action. Specifically, as noted above, the ingested material in the 0→30 degree and the 150→180 degree segments participates in a stirring action within the plenum P.

By adjusting the fractional valve openings and the rotational speed ($\omega$), an optimal combination of stirring and net flow rate can be achieved.

For a given angular speed ($d\theta/dt=\omega$) of the crankshaft 34A, the pressure: $P_{face}$ (t) on the forward face of the piston 16A will have a characteristic signature for an air-only operation and a given air density. (The non-dimensional representation: $\{[P_{face}-P_{atm}]/\rho V_p^2\}$ would be expected to be relatively independent from $\rho$ and $V_p$.) The presence of a dispersed phase, i.e., the powder paint, will require the pressure at the face of the piston 16A to be larger than the air-only case. This is shown in terms of the control volume momentum equation (for a control volume that is bounded by the interior faces of the sliding valve plate 58A, the lower surface of the cylinder wall 20A, the face of the piston 16A and the centerplane of the control valve: "c").

$$\vec{F}_s = \frac{d}{dt}\int_{c,v} \rho\vec{V}\,d\forall + \int \rho\vec{V}\vec{V}\cdot\hat{n}\,dA \tag{4}$$

where the x (streamwise) component of $\vec{F}$ is given as $$F_x = (p_{face} - p_c)A_{face} - \int_{A_{wdl}} \tau_w\,dA \tag{5}$$

and $\tau_W$ is the wall shear stress acting on the fluid. The latter term in (5) is expected to be small with respect to the first term (RHS) and it is expected to be negligibly influenced by the presence of the particulate matter.

Since the density of the powder is nominally $10^3$ times that of the continuous phase-air, a modest volume concentration (≈1 percent) will cause a readily measured increase in $p_{face}$ for a given rotational speed of the crankshaft 34A. Also, as noted above, it can be expected that $p_{face}=f(C_p)$ where $C_p$ is the concentration of the particles.

Industrial Application—Powder Paint

The suggested operating protocol for the controllable positive displacement pumps 10 and 10' in a powder paint application is to:

i) open the sliding plate 58A, and ii) open the rotary outlet valve assembly 100A at the beginning of the stroke of the piston 16A: $\theta\approx 0$, and monitor $P_{face}(t)$ at the beginning of the delivery stroke. Given a proper calibration environment and recorded data, one can infer the volume concentration from the measured $p_{face}$ over, e.g., the first 20 degrees of motion of the crankshaft 34A. Given this information, control circuitry can then coordinate—for $\theta>20$ degrees—the combined: a) closing of the rotary outlet valve 100A and b) opening the sliding plate 58A which will cause the previously ingested "charge" to be returned to the inlet plenum P. (The stirring effect will also clearly benefit the mixture homogeneity in the plenum P as noted above.)

The above described operational protocol addresses the two principal needs of the powder paint delivery hardware: i) to identify, and ii) to control the mass of the particulate material that is to be delivered to the applicator. The use of the upper/lower piston and cylinder configuration of FIG. 1 will result in a relatively continuous discharge of powder.

Industrial Application—HVAC Systems

Another application for the controllable positive displacement pump 10 is that of air delivery to the heating/cooling coils of an HVAC system. Of concern for such a system is the upstream propagation of flow noise. In particular, the parallel shear layers that are formed from the fixed inlet valves 50A and 50B are likely sources of acoustic noise.

Figure 12:
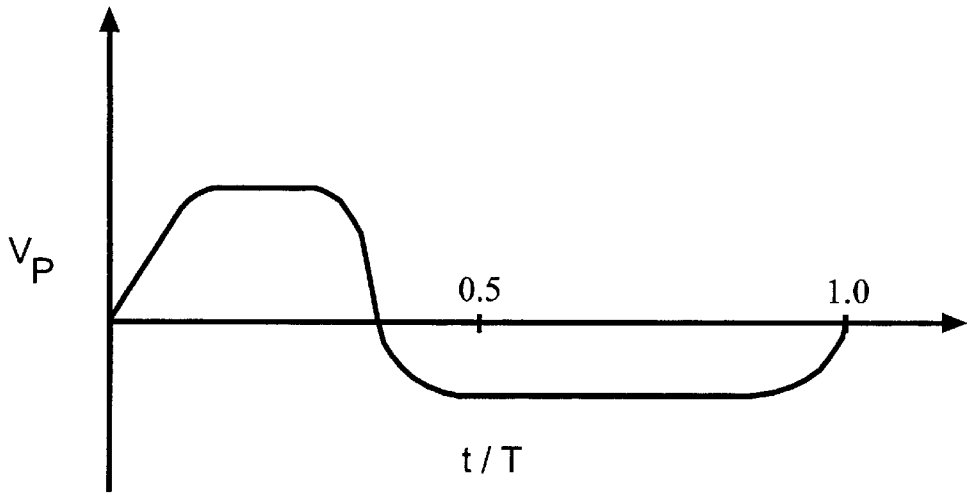
FIG. 12 is a graph presenting an asymmetric driving condition of a controllable positive displacement pump according to the present invention.

This concern suggests that the forward (pressurizing) stroke of the pistons 16A and 16B be executed relatively faster than the filling (return) stroke. Various mechanical linkages which can execute such drive patterns exist. FIG. 12 presents a representative $V_p(t)$ pattern than would meet the desired objectives. ($V_p$=velocity magnitude of the piston).

A concomitant advantage of this $V_p(t)$ pattern is that the velocity of air through the heating/cooling coils will be larger than would be the velocity in a symmetric-drive pattern. Specifically, the larger the velocity, the greater will be the momentary heat transfer and the greater will be the time averaged heat transfer for a given area of heat exchanger. This benefit is in addition to the intrinsic benefit of the positive displacement pump 10 according to the present invention for such heat transfer applications. Specifically, by creating twice the cycle average velocity over one-half of the heat exchanger for one-half of the cycle time, and repeating this behavior for the other one-half of the heat exchanger for one-half of the cycle time, a greater heat transfer will be obtained as enhanced heat transfer will derive from both the larger temperature differences and the larger convection heat transfer properties of the higher speed flow.

The foregoing disclosure is the best mode devised by the inventor for practicing this invention. It is apparent, however, that methods incorporating modifications and variations will be obvious to one skilled in the art of positive displacement pumps. Inasmuch as the foregoing disclosure presents the best mode contemplated by the inventor for carrying out the invention and is intended to enable any person skilled in the pertinent art to practice this invention, it should not be construed to be limited thereby but should be construed to include such aforementioned obvious variations and be limited only by the spirit and scope of the following claims.

I claim:

1. A controllable, positive displacement pump comprising, in combination, a drive motor, a pair of cylinders each having a sidewall and a head, a pair of pistons received in a respective one of said pair of cylinders, a crankshaft driven by said drive motor and having a respective pair of cranks for driving said pair of pistons, a pair of reciprocating inlet valves defining a pair of adjacent gratings disposed adjacent a respective one of said pair of cylinder sidewalls, and a pair of rotary outlet valves disposed adjacent a respective one of said pair of cylinder heads.

2. The controllable positive displacement pump of claim 1 wherein said pair of cranks are disposed in diametric opposition.

3. The controllable positive displacement pump of claim 1 wherein said drive motor is operably coupled to said reciprocating inlet valves and said rotary outlet valves and drives said crankshaft and said valves in synchronism.

4. The controllable positive displacement pump of claim 1 further including a second drive motor for driving said reciprocating inlet valves and said rotary outlet valves.

5. The controllable positive displacement pump of claim 4 further including tone wheels associated said crankshaft and said rotary outlet valves, sensors associated with said tone wheels and a controller for driving said drive motor and said second drive motor, said controller adapted to adjust the phase of said crankshaft and said rotary outlet valves.

6. The controllable positive displacement pump of claim 1 further including a second drive motor for reciprocating said inlet valves and a third drive motor for rotating said outlet valves.

7. The controllable positive displacement pump of claim 1 wherein said pair of adjacent gratings include elongate openings and wherein one of said gratings reciprocates transversely to said elongate openings.

8. The controllable positive displacement pump of claim 7 wherein at least one of said gratings define trapezoidal cross sections.

9. The controllable positive displacement pump of claim 1 further including a at least one drive belt pinion and at least one driven belt pinion associated with said drive motor and said rotary valves and at least one timing belt received on said belt pinions.

10. The controllable positive displacement pump of claim 1 further including a bevel gear drive having an input driven by said drive motor and an output driving at least one cam associated with said reciprocating inlet valves.

11. A controllable, positive displacement pump comprising, in combination, a drive motor, a pair of cylinders each having a sidewall and an end, a piston received in each of said pair of cylinders, a crankshaft driven by said drive motor and having a pair of cranks for driving a respective one of said pair of pistons, an inlet valve having a reciprocating grating associated with each of said pair of cylinder sidewalls, and a rotary outlet valve disposed adjacent each of said pair of cylinder heads.

12. The controllable positive displacement pump of claim 11 wherein said drive motor is operably coupled to said inlet valves and said rotary outlet valves and drives said crankshaft and said valves in synchronism.

13. The controllable positive displacement pump of claim 11 further including a second drive motor for driving said inlet valves and said rotary outlet valves.

14. The controllable positive displacement pump of claim 13 further including tone wheels associated said crankshaft and said rotary outlet valve, sensors associated with said tone wheels and a controller for driving said drive motor and said second drive motor, said controller adapted to adjust the phase of said crankshaft and said rotary outlet valves.

15. The controllable positive displacement pump of claim 11 further including a second drive motor for reciprocating said inlet valves and a third drive motor for rotating said outlet valves.

16. A controllable, positive displacement pump, comprising, in combination, a housing defining a pair of cylinders having sidewalls and ends, a piston received in each of said cylinders, a crankshaft defining a pair of diametrically opposed cranks, one of said cranks operably coupled to a respective one of said pistons, a reciprocating inlet valve having a pair of gratings disposed adjacent said cylinder sidewall and said cylinder and, a rotary outlet valve associated with each of said cylinders and disposed adjacent said cylinder end, and a drive assembly for providing energy to said crankshaft and said reciprocating inlet valves and said rotary outlet valves.

17. The controllable, positive displacement pump of claim 16 wherein said housing further defines a pair of plenums.

18. The controllable, positive displacement pump of claim 16 wherein said drive assembly includes a first drive motor for driving said crankshaft, a second drive motor for driving said reciprocating inlet valves and said rotary outlet valves, tone wheels associated with said first drive motor and said second drive motor, sensors associated with said tone wheels and a controller for driving said first drive motor and said second drive motor, said controller adapted to adjust the phase of said first drive motor and said second drive motor.

19. The controllable, positive displacement pump of claim 16 wherein said pair of adjacent gratings include elongate openings and wherein one of said gratings reciprocates transversely to said elongate openings.

20. The controllable, positive displacement pump of claim 16 wherein said drive assembly includes a drive motor driving said crankshaft and said valves in synchronism.

* * * * *